US006769458B2

(12) United States Patent
Froment

(10) Patent No.: US 6,769,458 B2
(45) Date of Patent: Aug. 3, 2004

(54) METHOD AND APPARATUS FOR GUIDING THE HARNESS CORDS OF A JACQUARD LOOM

(75) Inventor: Jean-Paul Froment, Doussard (FR)

(73) Assignee: Staubli Lyon, Chassieu (FR)

( * ) Notice: Subject to any disclaimer, the term of this patent is extended or adjusted under 35 U.S.C. 154(b) by 135 days.

(21) Appl. No.: 10/162,685

(22) Filed: Jun. 6, 2002

(65) Prior Publication Data

US 2002/0185191 A1 Dec. 12, 2002

(30) Foreign Application Priority Data

Jun. 8, 2001 (FR) ..... 01 07542

(51) Int. Cl.[7] ..... D03C 3/00
(52) U.S. Cl. ..... 139/59
(58) Field of Search ..... 66/59–85; 139/59, 139/60, 61, 62, 63, 64, 65, 85

(56) References Cited

U.S. PATENT DOCUMENTS 3,724,512 A * 4/1973 Kohl ..... 139/85
5,361,807 A * 11/1994 Giovenzana ..... 139/1 C
5,636,663 A 6/1997 Lacroix
5,762,112 A 6/1998 Feer
6,289,937 B1 9/2001 Feer

FOREIGN PATENT DOCUMENTS

| | | |
|---|---|---|
| EP | 0177385 | 4/1986 |
| EP | 0709503 | 5/1996 |
| EP | 1059373 | 12/2000 |
| FR | 2537167 | 6/1984 |

* cited by examiner

*Primary Examiner*—Danny Worrell
(74) *Attorney, Agent, or Firm*—Dowell & Dowell, P.C.

(57) ABSTRACT

A member for guiding harness cords of a weaving loom harness of Jacquard type which is provided with at least two plates with holes for passage of the cords and which plates are separated by a space adapted to be supplied with gas under pressure. The holes constitute orifices for exhaust of the gas with respect to the space. The guiding members makes it possible to cool the harness cords and to clean the holes through which the harness cords pass.

12 Claims, 2 Drawing Sheets

METHOD AND APPARATUS FOR GUIDING THE HARNESS CORDS OF A JACQUARD LOOM

BACKGROUND OF THE INVENTION

1. Field of the Invention

The present invention relates to a member for guiding the harness cords of a weaving loom harness of Jacquard type. It also relates to a Jacquard harness and to a shed-forming device incorporating such a guiding member. Finally, the invention relates to a method for guiding the harness cords of such a harness.

2. Description of the Related Art

In the domain of weaving looms of Jacquard type, it is known to guide the harness cords constituting the harness thanks to a perforated board disposed in the vicinity of the Jacquard system, i.e. in the upper part of the superstructure of the loom, and thanks to a comber board installed above the shed-formation zone, these boards making it possible to distribute the harness cords in space. The harness cords thus follow curved paths defined by the holes that they traverse, respectively, in the perforated board and in the comber board. Taking into account the angles of these paths with respect to the vertical, frictions are generated at the level of these holes, which generates heating and premature wear of the harness cords. Such wear is accentuated by the pollution of the zone of contact between the harness cords and the edges of these holes. In effect, flock tends to be deposited on these guiding members and to penetrate between the harness cords and the edges of these holes.

It is a more particular object of the present invention to overcome these drawbacks by proposing a novel structure of guiding member which makes it possible to limit heating and wear of the cords.

SUMMARY OF THE INVENTION

To that end, the invention relates to a guiding member of the aforementioned type which is provided with holes for passage of the harness cords and which is characterized in that these holes are arranged in such a manner that at least one harness cord passes through two holes which communicate with at least one space adapted to be placed under excess pressure by a supply from a source of pressurized gas, these holes constituting orifices for exit of the gas with respect to the space.

With the invention, the substantially closed space or volume defined between two plates in which the holes are made serves as a distributor for the pressurized gas, for example air. "Excess pressure" is understood to mean that the pressure of the gas, in the volume defined between the afore-mentioned plates, is greater than ambient atmospheric pressure. The gas thus tends to escape through the orifices made in the plates. This gas sweeps over the harness cords which it cools, while it drives flock away from edges of the holes through which the cords pass. In other words, the circulation of the gas, which passes from the inside of the guiding member to the outside, cleans areas of contact between the harness cords and the plates, which makes it possible to eliminate or limit the abrasion of the harness cords. This circulation also induces cooling of these cords, which makes it possible to limit the losses of their technical characteristics which occur with the conventional devices. In this way, the life of the harness of a Jacquard loom equipped with a guiding member according to the invention is increased, while the speeds and the loads applied to this harness may be increased. In addition, the maintenance operations can be spaced out, including in the case of a loom working in a polluted atmosphere. Finally, the internal volume or space of the guiding member makes it possible to distribute the cooling/cleaning gas, with the result that all the harness cords are cooled and cleaned in substantially uniform manner.

According to advantageous but non-obligatory aspects of the invention, the guiding member incorporates one or more of the following characteristics:

- the two holes are made in two plates separated by the aforementioned volume or space.
- the holes provided, respectively, on a first and on a second plate are substantially aligned with respect to one another in a substantially vertical direction when the guiding member is mounted on a weaving loom.
- at least one connection is provided, for connecting each internal volume or space of the guiding member to an outside source of gas under pressure; and
- spacer elements are provided for separating the aforementioned plates, these spacers forming peripheral partitions defining each volume or space. In that case, the aforementioned connection is advantageously immobilized on and traverses one of these spacers.

According to a first advantageous embodiment of the invention, the guiding member forms a perforated board disposed in the vicinity of a Jacquard system for guiding the harness cords. According to another advantageous embodiment of the invention, this member forms a comber board.

The invention also relates to a Jacquard harness which comprises a guiding member as defined hereinabove. The life of such a harness is substantially increased with respect to those of the prior art.

The invention also relates to a shed-forming device of a weaving loom of the Jacquard type which comprises a guiding member as described hereinabove. Such a shed-forming device is easier to use and more economical than the known devices.

Finally, the invention relates to a method for guiding harness cords which may be carried out with a guiding member as described hereinabove. This method comprises steps consisting in causing the harness cords to pass through a guiding member provided with two plates in which holes are made for passage of these cords and between which a substantially closed volume is defined, and in supplying this volume with pressurized gas, with the result that the gas escapes from this volume through these holes.

BRIEF DESCRIPTION OF THE DRAWINGS

The invention will be more readily understood on reading the following description of an embodiment of a shed-forming device incorporating a guiding member according to the invention, given solely by way of example and made with reference to the accompanying drawings, in which.

DESCRIPTION OF PREFERRED EMBODIMENT

Figure 1:
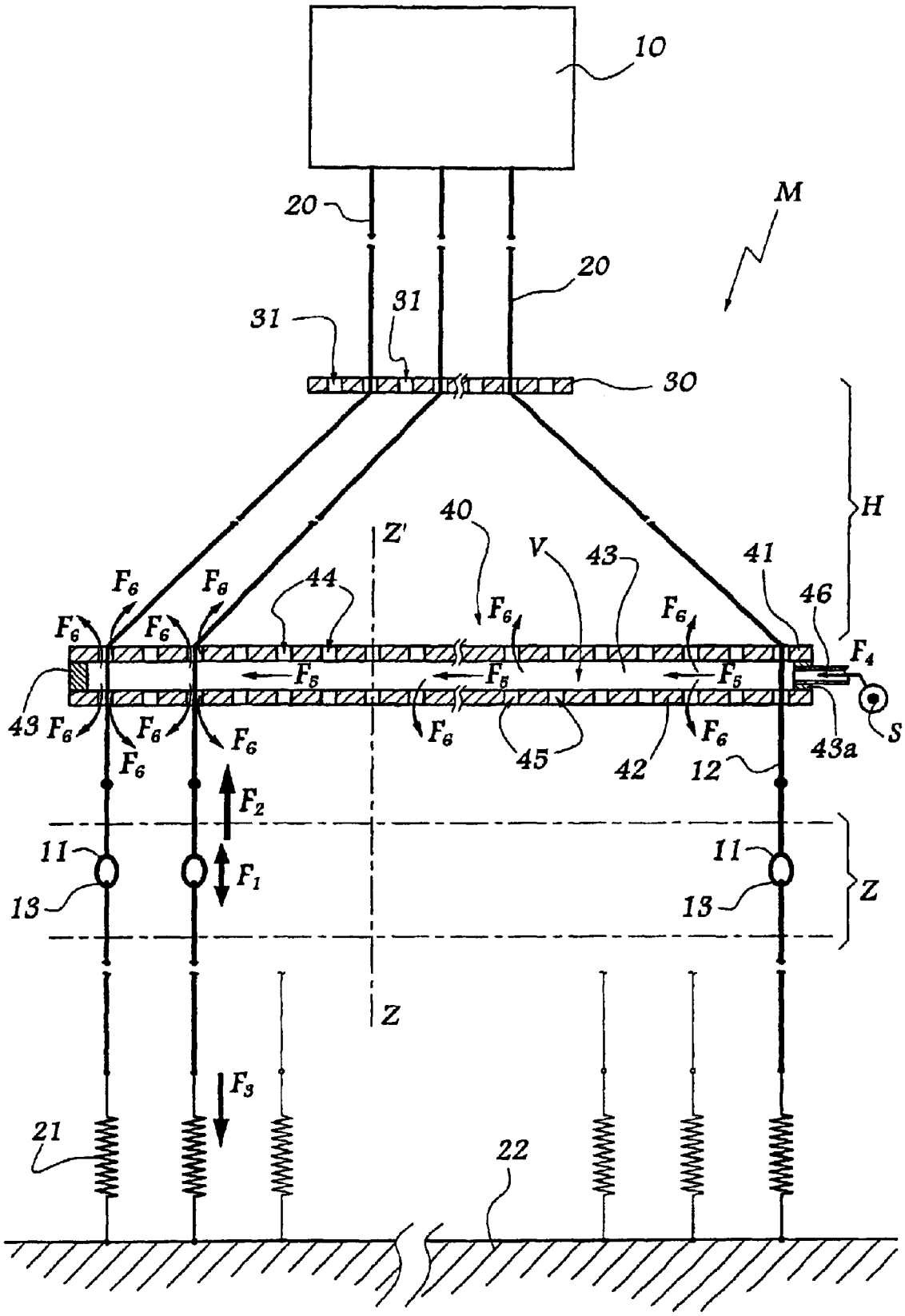
FIG. 1 schematically shows a shed-forming device according to the invention mounted on a weaving loom.
Figure 2:
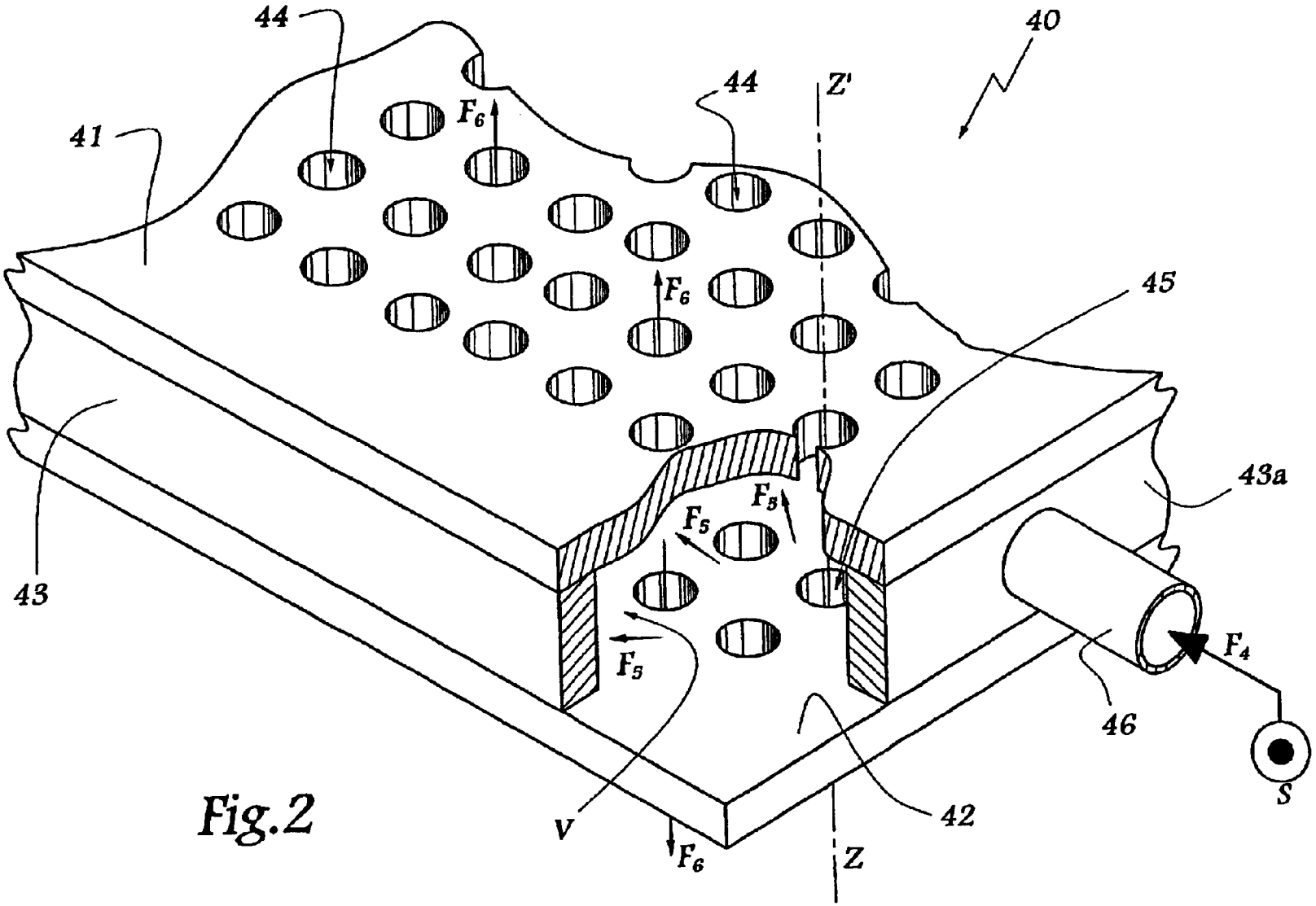
FIG. 2 is a partial view, in pespective and with parts torn away, of the comber board of the device of FIG. 1.

Referring now to the drawings, the weaving loom M shown in FIG. 1 is equipped with a Jacquard system 10 supported by a superstructure (not shown) above the zone Z in which the eyes 11 of heddles 12 are displaced, these eyes being traversed by the warp yarns 13 of the loom.

The heddles 12 are animated by a substantially vertical movement of oscillation, represented by the double arrow $F_1$. The heddles 12 are subjected to tractive forces $F_2$ and $F_3$ respectively exerted by harness cords 20 and by springs 21 fixed to the frame 22 of the machine.

The harness cords 20 which belong to a harness H, are controlled by the system 10 and each follow a path between this system and the heddle 12 associated therewith. The path of each cord 20 is defined by a perforated board 30, disposed in the vicinity of the system 10, and by a comber board 40, disposed above the zone Z at a relatively small height with respect thereto. The elements 30 and 40 thus constitute members for guiding the cords 20.

The board 30 is provided with holes 31 for passage of the cords 20.

The board 40 comprises an upper plate 41 and a lower plate 42 between which is defined a volume V delimited by spacer elements 43 which are four in number and form the peripheral partitions of the volume V, bordering the edges of the plates 41 and 42.

The plates 41 and 42 are respectively provided with holes 44 and 45 for passage of the cords 20. When the board 40 is in mounted configuration on the loom M, the holes 44 and 45 are aligned in directions parallel to a substantially vertical axis Z–Z', with the result that the cords 20 are substantially vertical when they pass through the comber board 40. However, at least certain of the cords 20 are inclined above the board 40.

The volume V is thus substantially isolated from the ambient atmosphere by the partitions 43. However, this volume communicates with its environment through holes 44 and 45.

In FIG. 1, only a few cords 20 have been shown in order to render the drawing clearer, while the number of harness cords of the harness H may attain and even exceed 10,000 units.

One, 43*a*, of the spacer elements 43 is equipped with a connection 46 passing through the spacer and making it possible to connect the volume V to a source S of pressurized air. The connection 46 thus constitutes a means for connection of the volume V to the source S.

It is thus possible to supply the volume V with pressurized air, as represented by arrow $F_4$. This air is distributed within the volume V, as represented by arrows $F_5$ and exits from the board 40 through the holes 44 and 45, as represented by arrows $F_6$.

In this way, a flow of air, represented by arrows $F_6$, permanently sweeps the cords 20 in their areas of contact with the plates 41 and 42, i.e. at the holes 44 and 45. This has the effect of cooling these cords and of evacuating or removing flock or impurities which might accumulate in these holes.

In other words, the holes 44 and 45 constitute orifices for exhaust of the airflow $F_4$–$F_5$–$F_6$ coming from the source S through the volume V.

The boards 30 and 40 form part of the harness H as they are mounted on the loom M with the harness cords 20.

The volume V may be divided into a plurality of separate volumes, separated by intermediate partitions and supplied with compressed air individually. In that case, a plurality of connections of the type of connection 46 may be provided.

The invention has been described with a source S of air, but it may be used with other gases.

The invention has been shown implemented on a comber board. However, it may be embodied in the perforated board 30, which, in that case, comprises two plates between which a volume of the type of volume V described above is defined.

What is claimed is:

1. A guiding member for guiding harness cords of a harness of a weaving loom of Jacquard type, the guiding member being provided with holes for passage of said cords, wherein said holes are arranged in such a manner that at least one harness cord passes through two spaced holes which communicate with a space therebetween which is placed under excess pressure by supply from a source of pressurized gas, and said holes constituting orifices for exhaust of the gas from said space.

2. The guiding member of claim 1, wherein said two holes are made in first and second plates which define said space therebetween.

3. The guiding member of claim 2, wherein said holes in said first and second plates are substantially aligned with respect to one another in a substantially vertical direction when the guiding member is mounted on a weaving loom.

4. The guiding member of claim 1, including at least one connection for connecting said space to an outside source of pressurized gas.

5. The guiding member of claim 2, including spacers for separating said first and second plates, said spacers forming peripheral partitions defining said space.

6. The guiding member of claim 5, wherein said at least one connection is immobilized on and traverses one of said spacers.

7. The guiding member of claim 1, wherein the guiding member forms a perforated board disposed in a vicinity of a Jacquard system for guiding the harness cords.

8. The guiding member of claim 1, wherein the guiding member forms a comber board for guiding the harness cords.

9. A harness of a weaving loom of Jacquard type comprising harness cords controlled by a Jacquard system, wherein the harness includes a guiding member according to claim 1.

10. A shed-forming device on a weaving loom of a Jacquard type, wherein the shed-forming device includes a guiding member according to claim 1 for guiding harness cords of the loom.

11. A method of guiding the harness cords of a harness of a weaving loom of Jacquard type, comprising the steps of:

causing the harness cords to pass through a guiding member provided with at least two spaced plates in which holes are made for passage of the cords and between which is defined a substantially closed space, and supplying the space with gas under pressure, with the result that the gas escapes from the space through the holes.

12. The method of claim 11, including using air as the gas under pressure.

* * * * *